US008273231B2

(12) United States Patent
Creech

(10) Patent No.: US 8,273,231 B2
(45) Date of Patent: Sep. 25, 2012

(54) METHODS OF DEPOSITING COATINGS WITH γ-NI + γ'-$NI_3$A1 PHASE CONSTITUTION

(75) Inventor: George Edward Creech, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1114 days.

(21) Appl. No.: 11/963,249

(22) Filed: Dec. 21, 2007

(65) Prior Publication Data

US 2009/0162684 A1 Jun. 25, 2009

(51) Int. Cl.
*C25D 13/00* (2006.01)

(52) U.S. Cl. ..... 204/484; 204/487; 428/548; 427/203

(58) Field of Classification Search ..... 204/484, 204/490, 491
See application file for complete search history.

(56) References Cited

U.S. PATENT DOCUMENTS

| | | | | |
|---|---|---|---|---|
| 3,962,059 | A | 6/1976 | Kaup et al. | |
| 4,031,274 | A | 6/1977 | Bessen | |
| 5,057,196 | A * | 10/1991 | Creech et al. | 428/652 |
| 5,071,678 | A | 12/1991 | Grybowski et al. | |
| 5,366,765 | A | 11/1994 | Milaniak et al. | |
| 5,807,428 | A | 9/1998 | Bose et al. | |
| 5,824,366 | A | 10/1998 | Bose et al. | |
| 5,958,204 | A | 9/1999 | Creech et al. | |
| 5,976,337 | A | 11/1999 | Korinko et al. | |
| 6,110,262 | A | 8/2000 | Kircher et al. | |
| 6,273,678 | B1 | 8/2001 | Darolia | |
| 6,294,261 | B1 | 9/2001 | Sangeeta et al. | |
| 6,332,926 | B1 | 12/2001 | Pfaendtner et al. | |
| 6,406,561 | B1 * | 6/2002 | Creech et al. | 148/242 |
| 6,497,920 | B1 | 12/2002 | Pfaendtner et al. | |
| 6,586,052 | B2 | 7/2003 | Creech et al. | |
| 6,613,445 | B2 | 9/2003 | Sangeeta et al. | |
| 7,056,555 | B2 | 6/2006 | Bauer et al. | |
| 2003/0044536 | A1 * | 3/2003 | Rigney et al. | 427/383.1 |
| 2004/0229075 | A1 * | 11/2004 | Gleeson et al. | 428/629 |
| 2006/0127695 | A1 * | 6/2006 | Gleeson et al. | 428/670 |
| 2010/0086680 | A1 | 4/2010 | Creech et al. | |

FOREIGN PATENT DOCUMENTS

DE EP 1462537 A2 * 9/2004

(Continued)

OTHER PUBLICATIONS

Notification of Transmittal of the International Search Report and the Written Opinion of the International Searching Authority, or the Declaration from corresponding PCT Application No. PCT/US2008/013853, mailed Jun. 2, 2009, (12 pages).

Chen, "Slurry development for the deposition of a GdSiO4+Mullite environmental barrier coating on silicon carbide," Journal of Ceramic Processing Research, vol. 8, No. 2, pp. 142-144, 2007.

U.S. Appl. No. 12/750,971, filed Mar. 31, 2010.

(Continued)

*Primary Examiner* — Jeffrey T Barton
*Assistant Examiner* — Steven Rosenwald
(74) *Attorney, Agent, or Firm* — Shumaker & Sieffert, P.A.

(57) ABSTRACT

A method including depositing a powder on a substrate to form a first layer thereon, wherein the layer includes a Pt group metal, Si and reactive element selected from the group consisting of Hf, Y, La, Ce, Zr, and combinations thereof. Deposited on the first layer is a second layer including Al to form a coating with a γ-Ni+−γ'$Ni_3$Al phase constitution. In preferred embodiments, the second layer is deposited with an organo halocarbon activator.

30 Claims, 13 Drawing Sheets

FOREIGN PATENT DOCUMENTS

| | | | |
|---|---|---|---|
| DE | 102007050141 | A1 | 7/2010 |
| EP | 1 010 774 | A1 | 6/2000 |
| EP | 1088908 | A2 | 4/2001 |
| EP | 1609885 | A1 | 12/2005 |
| EP | 1462537 | A2 | 4/2008 |
| EP | 1978210 | A1 | 10/2008 |
| WO | WO/01/05579 | A2 | 1/2001 |
| WO | 2009/085188 | A1 | 7/2009 |

OTHER PUBLICATIONS

International Preliminary Report on Patentability from international application No. PCT/US2008/013853, dated Jun. 22, 2010, 8 pp.

Examination Report conducted by the Hungarian Intellectual Property Office received from the Intellectual Property Office of Singapore for Singapore application No. 201004418-8 mailed Aug. 4, 2011, 7 pp.

* cited by examiner

METHODS OF DEPOSITING COATINGS WITH γ-NI + γ'-$NI_3$A1 PHASE CONSTITUTION

TECHNICAL FIELD

The disclosure relates to methods for depositing coatings including a γ-Ni+γ'-$Ni_3$Al phase constitution.

BACKGROUND

Platinum-modified aluminide (PtAl) coatings have been formed by electroplating Pt onto a substrate, applying a short high temperature heat treatment, applying a layer of Al, and performing a diffusion heat treatment cycle.

Using this basic process, it is possible to make different classes of PtAl coatings. The resulting phase structure of the resulting coatings can depend upon a number of factors, such as, for example, the thickness of the initial Pt plate, the post-plate diffusion cycle parameters, and the type of aluminizing cycle.

When applied after the short high temperature heat treatment, a low temperature high activity aluminizing cycle process (LTHA) typically yields a two-phase PtAl coating with an outer layer making up about 65% of the total thickness, with the diffusion zone accounting for only about a third of the coating thickness. LTHA processes also typically require a post-coat diffusion heat treatment to form the final coating. For such two-phase coatings, the Pt content in the outer layer can range from about 25 wt. % to about 50 wt. % or higher. If a high temperature low activity (HTLA) aluminizing process is applied following heat treatment, the resulting PtAl coating may be either two-phase or single-phase, depending upon the specific process parameters. The HTLA process usually includes adequately high temperatures to allow the aluminum to diffuse into the PtAl structure during the application step. The single-phase PtAl coatings formed by a HTLA process generally have Pt contents in the 15-30 wt. % range, with the outer zone of the coating making up only approximately 50% of the total thickness. The diffusion zone is generally from about 40% to about 50% of the total thickness.

SUMMARY

However, Pt electroplating solutions require careful maintenance of temperature and pH, and may be susceptible to "poisoning" if impurities are inadvertently introduced during the processing of parts. Some Pt plating solutions may also incorporate unacceptable levels of sulfur (S) and/or phosphorous (P) into the deposited Pt, which has undesirable effects on the coating properties. Additionally, the masking of areas on substrates where Pt is not desired must be of materials that are not attacked by strong acids (or bases depending on the process) and are able to withstand higher temperatures. Further, some care is required to ensure that no strong acids or bases (depending on the specific type bath used) that could initiate chemical attack when exposed to higher temperatures in subsequent processing are entrapped inside hollow part assemblies during the Pt electroplating.

Current processes for producing coatings including a γ-Ni+γ'-$Ni_3$Al phase constitution require either pack cementation or chemical vapor deposition (CVD) to apply an Al layer on the Pt layer. Pack cementation expends tremendous amounts of energy and may create significant amounts of waste that must be disposed of. Additionally, the inert filler material used in pack cementation makes thermal uniformity within a set of retorts more difficult to achieve, and can create a non-uniform coating thicknesses. In particular, coating uniformity for complex geometries may be challenging when using pack cementation.

Alternately, when CVD methods are used to apply the Al layer, specialized and potentially expensive equipment may be required to provide necessary safety features to protect the workers from the fluoride or chloride containing gases that may be generated. This also may add costs to the process. In addition, CVD processes can make masking of areas on substrates where coating is not desired more challenging due to the pervasive nature of gaseous reactants involved.

Additionally, it may be difficult to co-deposit Al and a reactive element, such as Hf, as is the current practice when producing coatings having a γ-Ni+γ'-$Ni_3$Al phase constitution. Reactive elements such as Hf have a very different molecular weight than Al, and thus have different reactivity in the gas phase, which can affect both pack cementation and CVD co-deposition of a reactive element and Al.

In one aspect, the present disclosure is directed to a method including depositing a powder on a substrate to form a first layer thereon, wherein the first layer includes a Pt group metal, Si and reactive element selected from the group consisting of Hf, Y, La, Ce, Zr, and combinations thereof. Deposited on the first layer is a second layer including Al to form a coating with a γ-Ni+−γ'$Ni_3$Al phase constitution. In preferred embodiments, the second layer is deposited with an organo halocarbon activator.

The coating methods described in the present disclosure may provide one or more advantages. For example, the coating methods can provide more precise control of the total amount of Al in the γ-Ni+−γ'$Ni_3$Al coating. The composition of the coating is more compatible with the composition of the underlying substrate on which the coating is applied, and the coating is more resistant to oxidation.

Other advantages provided by the coating methods described in the present disclosure may include a lower susceptibility to poisoning of the electrophoretic bath compared to an electroplating bath, exclusion of S and P from the deposited Pt, and the omission of acids or bases from the electrophoretic bath. The electrophoretic deposition of Pt, Si, and a reactive element may also be more economical than electroplating, and may be easier than the co-deposition of Al and the reactive elements.

Additionally, electrophoretic deposition may be less sensitive to the geometry of the part which is to be plated. That is, the coating deposited by electrophoretic deposition may deposit coatings having a substantially uniform thickness, even on parts with complex three-dimensional geometry.

The details of one or more embodiments of the invention are set forth in the accompanying drawings and the description below. Other features, objects, and advantages of the invention will be apparent from the description and drawings, and from the claims.

DETAILED DESCRIPTION

In one aspect, the current disclosure is directed to methods for making coatings including a $\gamma$-Ni+$\gamma'$-$Ni_3Al$ phase constitution, which in this application refers to an alloy including a Pt-group metal, Ni and Al in relative concentration such that a $\gamma$-Ni+$\gamma'$-$Ni_3Al$ phase constitution results in some portion of the coating. In some embodiments, the concentration of Al is limited with respect to the concentration of Ni and the Pt-group metal such that substantially no $\beta$-NiAl phase structure, preferably no $\beta$-NiAl phase structure, is present in the alloy, and the $\gamma$-Ni+$\gamma'$-$Ni_3Al$ phase constitution predominates. Exemplary alloys and coatings with a $\gamma$-Ni+$\gamma'$-$Ni_3Al$ phase constitution are described in, for example, U.S. Pat. No. 7,273,662, which is incorporated by reference herein in its entirety.

While coatings including a $\gamma$-Ni+$\gamma'$-$Ni_3Al$ phase constitution are generally preferred, the methods described herein may be used to make coatings including up to about 33 at.% Al, which results in a coating having a substantially $\beta$-NiAl phase structure. Thus, while this disclosure is primarily directed to producing coatings having a $\gamma$-Ni+$\gamma'$-$Ni_3Al$ phase constitution, the invention is not limited to such coatings.

The $\gamma$-Ni+$\gamma'$-$Ni_3Al$ coatings may be applied on any substrate, and are particularly well suited for application on superalloy substrates including Ni and Co. Any conventional superalloy substrate may be used, including, for example, those available from Martin-Marietta Corp., Bethesda, Md., under the trade designation MAR-M247; those available from Cannon-Muskegon Corp., Muskegon, Mich., under the trade designation CMSX-4, CMSX-10; and the like. Typical superalloy substrate constituents such as, for example, Cr, Co, Mo, Ta, Ti, W, Re, and combinations thereof, may optionally be added to or present in the alloy composition to the extent that a $\gamma$-Ni+–$\gamma'Ni_3Al$ phase constitution is present.

Figure 2:
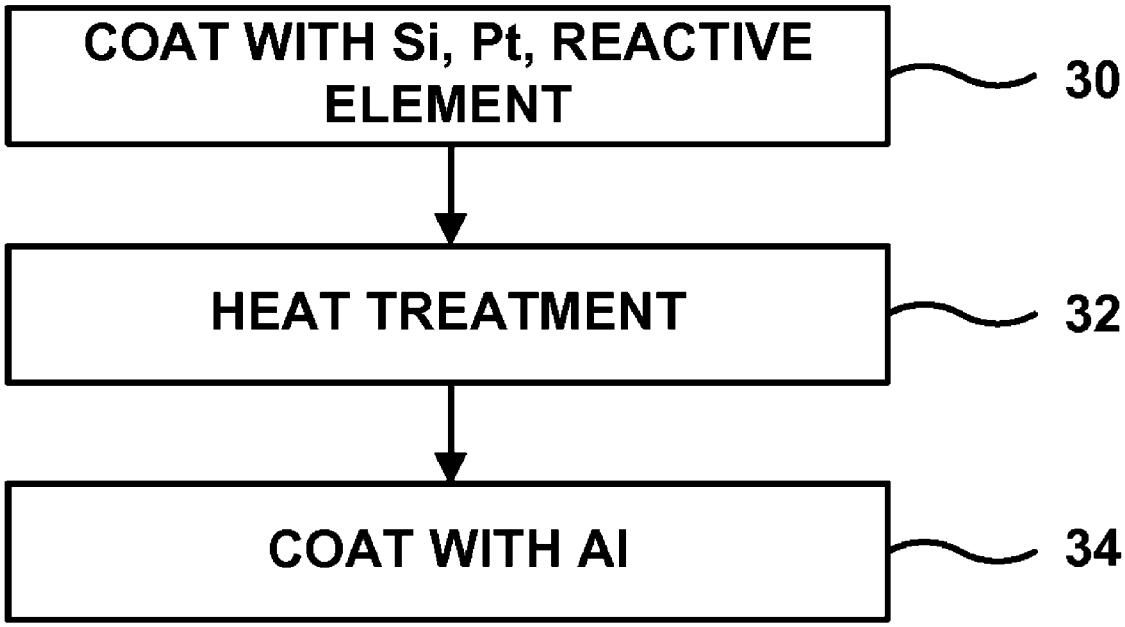
FIG. 2 is a flowchart illustrating an example method of coating a substrate.

FIG. 2 shows an overview of an exemplary method of coating a substrate, which will be discussed with further reference to FIGS. 3-5. The substrate can initially be coated with a first layer including Si, a Pt-group metal, and at least one reactive element such as, for example, Hf, Y, La, Ce, Zr and combinations thereof (30). Any suitable coating method may be used to apply the first layer, and electrophoretic deposition is preferred.

Figure 3:
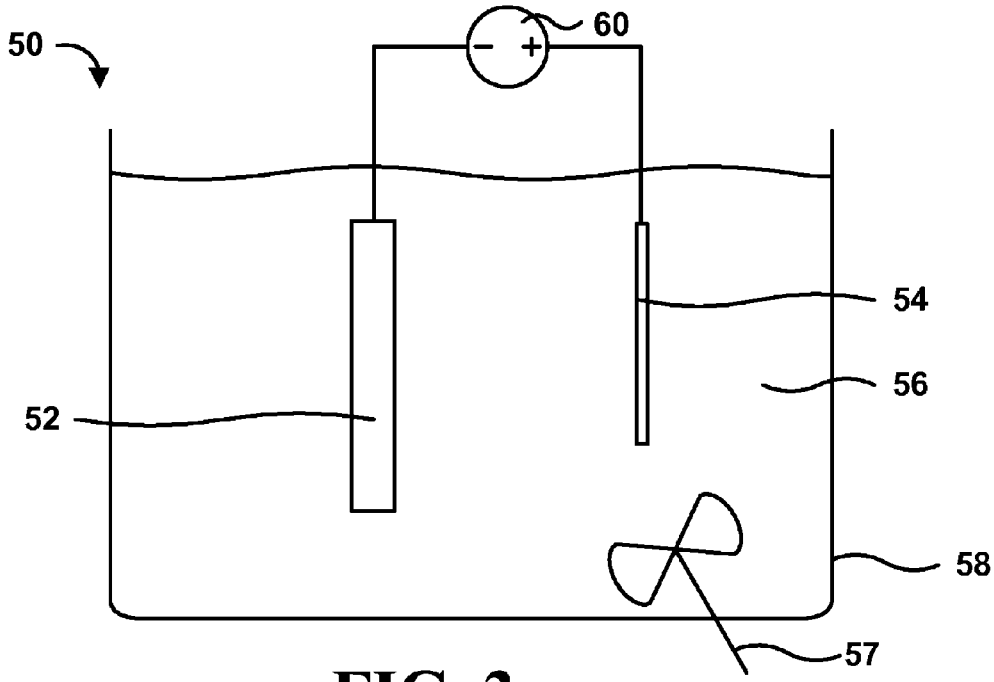
FIG. 3 is a side view illustrating a metallic substrate immersed in an electrophoretic bath.
Figure 4:
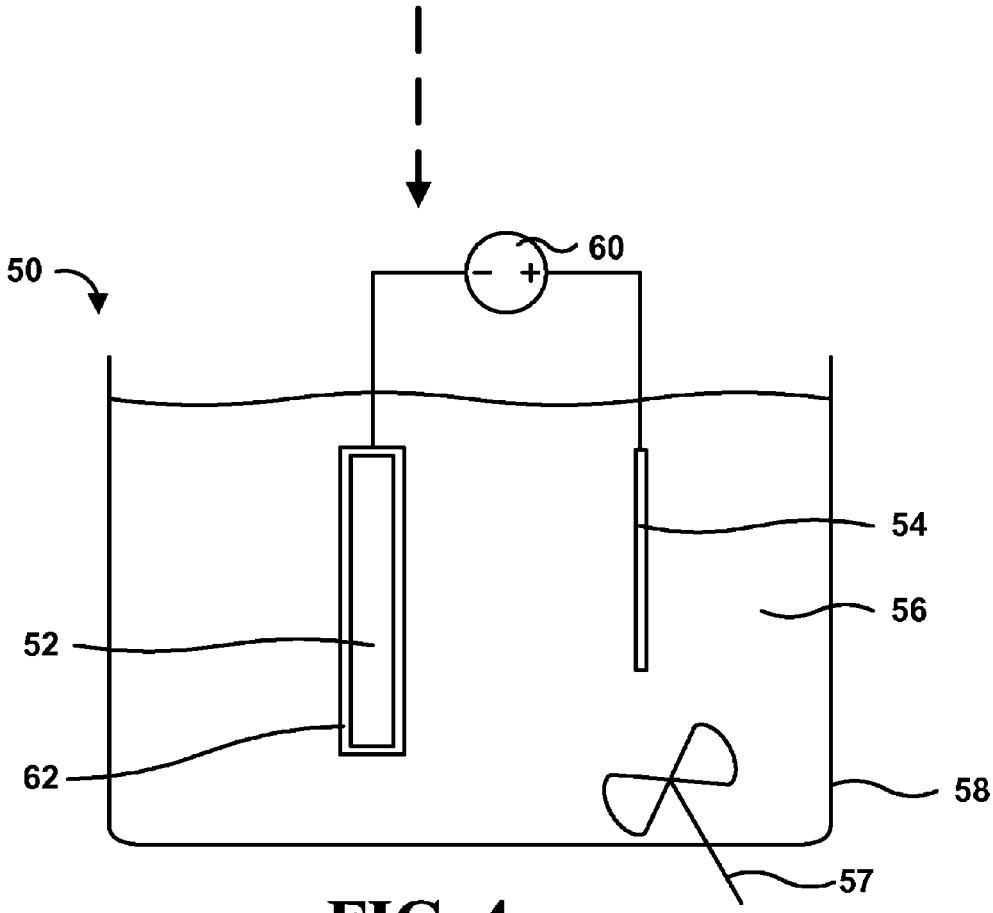
FIG. 4 is a side view illustrating a metallic substrate immersed in an electrophoretic bath coated with a layer including a Pt-group metal, a reactive element, and Si.

FIG. 3 is a block diagram illustrating a simplified exemplary electrophoresis bath apparatus 50. In an electrophoretic coating process, the substrate 52 is electrically coupled to a DC voltage source 60 as a cathode. Substrate 52 is submerged in an electrophoretic bath 58 which may include a suspension 56 with a liquid carrier, solids (including the constituents of the coating composition and any activator), and any other desired additives, such as surfactants, oxidizers, and the like. The suspension 56 is agitated by an impeller 57 or other suitable agitator to keep the solids and additives in suspension. A suitable conductive material 54 is electrically coupled to DC voltage source 60 as an anode and submerged in bath 58. A DC voltage is applied between substrate 52 and conductive material 54, causing a current to flow. The current causes the positively charged coating composition, which may be present in the suspension 56 as a metal/zein ($Co^{++}$) complex species, to be attracted to the cathode, where they contact the substrate 52, are deposited on the substrate 52 surface, and are bonded onto the substrate 52 surface in a layer 62, as shown in FIG. 4.

The solids in the suspension 56 include a Pt-group metal such as, for example, Pt, Pd, Ir, Rh, Ru, and combinations thereof, and Pt is preferred. The solids in the suspension 56 further include at least one reactive element such as, for example, Hf, Y, La, Ce, Zr and combinations thereof, and Hf is preferred. The addition of such reactive elements tends to stabilize the $\gamma'$ phase in the final alloy composition. Therefore, if sufficient reactive metal is incorporated into the composition, the resulting phase constitution may be predominately $\gamma'$, or solely $\gamma'$. In addition, the solids in the suspension 56 may also include Si.

The solids may be prepared by forming an alloy including the Pt-group metal, reactive element, and Si. The alloy may then be ground into a powder and deposited in the suspension. The alloying and subsequent grinding may result in an alloy powder having a substantially homogeneous composition of Pt-group metal, reactive element, and Si.

Grinding may result in an alloyed powder that includes particles with a size distribution. That is, not all particles in the alloyed powder are necessarily the same size (e.g., diameter). The alloyed powder may include a relatively wide range of particle sizes, depending on the parameters of the electrophoretic electrodeposition process. In certain embodiments, it is preferred that the size of a majority of particles in the alloyed powder ranges from about 1 μm to about 20 μm, more preferably from about 5 μm to about 10 μm. Grinding may also introduce small amounts of impurities into the alloyed powder. Impurities introduced into the alloyed powder may include, for example, Al and O, primarily in the form of $Al_2O_3$.

The alloyed powder is preferably substantially free of impurities, but may include up to about 5 wt. % impurities. The alloyed powder also preferably includes less than about 3 wt. % $O_2$. If the oxygen is combined with the reactive element in the alloy such as Hf, it may not be fully incorporated into the substrate during diffusion heat treatment. Special precautions such as using a dry box with high purity argon during the preparation of the alloy mixture, pressing mixture into a compact, and performing the alloying in extremely tight furnace that eliminates traces of oxygen during the alloying process have been shown to be beneficial in producing alloy powders containing Pt, Si, and Hf. A stepped heat treatment used during alloying is useful in producing a homogenous alloy.

In one embodiment, to provide a Pt-group-metal modified γ-γ' alloy in the first layer, the solids in the suspension 56 include about 84 wt. % to about 93 wt. % Pt-group metal, about 3 wt. % to about 12 wt. % Si, and about 2 wt. % to about 6 wt. % of the at least one reactive element, based on the total weight of solids content in the suspension 56.

The total solids content in the suspension may be about 15 grams solids per liter liquid carrier to about 40 grams solids per liter liquid carrier, preferably about 30 grams solids per liter liquid carrier.

The liquid carrier preferably in the suspension 56 may vary widely so long as it has compatibility with the solids therein, and a variety of organic solvents may be used. The liquid carrier preferably is essentially anhydrous, i.e., is preferably essentially free of water. Preferred liquid carriers also have at least one of a high specific gravity and a high dielectric constant. Preferred liquid carriers also dissolve an electrophoretically active agent up to a concentration of about 5 g/L. Additionally, preferred liquid carriers do not react with an activating agent such as those described in further detail below.

In one embodiment useful for making γ-Ni+−γ'$Ni_3Al$ alloys, the liquid carrier includes about 55 wt. % to about 65 wt. % isopropanol and about 35 wt. % nitromethane to about 45 wt. % nitromethane, more preferably about 60 wt. % isopropanol and about 40 wt. % nitromethane.

The suspension 56 further includes an electrophoretically active agent such as zein, gliadin, synthetic methyl cellulose, and the like. The electrophoretically active agent, in conjunction with an activating agent, may form a chelated complex with the metals in the suspension that has a positive charge. The electrophoretically active agent is present in the suspension at about 1 g/L to about 3 g/L, more preferably about 2.2 g/L.

The suspension 56 further includes an activating agent. Suitable activating agents include transition metal nitrates having divalent (+2) charges that can form a chelated complex with the electrophoretically active agent. In some embodiments, preferred activating agents include nickel nitrate hexahydrate, cobalt nitrate hexahydrate, and the like. The activating agent is typically present in the suspension at about 0.08 g/L to about 0.20 g/L, and a concentration of about 0.14 g/L is suitable.

The chelated complex formed by the electrophoretically active agent and the activating agent may surround the metal particles in the suspension 56 and impart a slight positive charge that causes the encased particle to migrate to and deposit on the negatively charged substrate 52 (cathode).

Electrophoretic deposition of the Pt-group metal, reactive element, and Si may be carried out for up to about 6 minutes at a current density of about 1 to about 2 $mA/cm^2$ between the anode and cathode (substrate 52). Suitable voltages range from about 35 V to about 250 V, and may be chosen to provide the desired current density. The necessary voltage may be influenced by the composition of the electrophoretic bath and the distance between the anode and cathode (substrate 52). The suspension is maintained by mechanical agitation including, for example, an impeller 57. Further details regarding electrophoretic deposition processes are provided in U.S. Pat. Nos. 5,057,196 and 5,958,204 both to Creech et. al, which are incorporated herein by reference in their entirety. The weight of the coating deposited may range from about 5 $mg/cm^2$ to about 30 $mg/cm^2$, preferably about 10 $mg/cm^2$ to about 20 $mg/cm^2$.

After completion of the electrophoretic deposition of the Pt-group metal, Si and at least one reactive element, the coated substrate 52/62 is removed from the bath 58. The coated substrate 52/62 is then subjected to a heat treatment step (32). The heat treatment enables the Pt-group metal, Si, and at least one reactive element to diffuse into the substrate and the substrate elements to diffuse into the coating. The heat treatment step may be performed at temperatures ranging from about 1800° F. to about 2200° F. for about 15 minutes up to about 1 hour. Preferably, the diffusion heat treatment step occurs in an inert atmosphere, such as under a vacuum.

Following the heat treatment step, the first layer coating includes up to about 30 at.% of at least one Pt-group metal, up to about 2 at.% of at least one reactive element, and up to about 28 at.% Si. The first layer includes about 10 at.% to about 30 at.% of a Pt-group metal, about 0.3 at.% to about 2 at.% of a reactive element, and about 2 at.% to about 28 at.% Si. The first layer coating may also include up to about 20 at.% Al, up to about 8 at.% Cr, and up to about 8 at.% Co as a result of diffusion from the superalloy substrate, as well as Ni and other superalloy substituents. The first layer coating includes about 10 at.% to about 20 at.% Al, about 2 at.% to about 8 at.% Cr, and about 4 at.% to about 8 at.% Co. All of the above values are nominal, and may vary up to about ±1-2 at.%.

As an example, in one embodiment, the diffusion heat treatment resulted in a coating including about 13 at.% Al, about 25 at.% Pt, about 5 at.% Si, about 1.5 at.% Hf, about 4 at.% Cr, about 6 at.% Co, Ni, and incidental amounts of other superalloy substrate elements. In the same example, the phase constitution of the resulting coating was about 85% γ'-$Ni_3Al$ and about 15% γ-Ni.

The coated substrate 52/62 may then be coated with a second layer including Al (34). The second layer may increase the amount of Al present in the final coating. The Al deposition may be accomplished using any conventional coating technique, including pack cementation. When pack cementation is utilized, coated substrate 52/62 is buried in a ceramic boat by a pack.

Coating thickness and composition may be controlled by selecting appropriate pack cementation times and temperatures, and also by controlling the composition of the pack. In preferred embodiments, the pack may include about 0.5 wt. % to about 1 wt. % Al, about 1 wt. % to about 5 wt. % organo halocarbon powder, and the balance 90 grit aluminum oxide.

The coated substrate and pack are then heated to a temperature between about 1475° F. to about 1925° F. for about 1 hour to about 4 hours, which causes the coating materials in the pack to deposit on to the coated substrate 52/62.

Additionally, one or more reactive elements may be included in the pack mixture in amounts up to about 5 wt. %, if desired. The inclusion of one or more reactive element in the second layer may increase the concentration of the one or more reactive element in the final coating.

Figure 5:
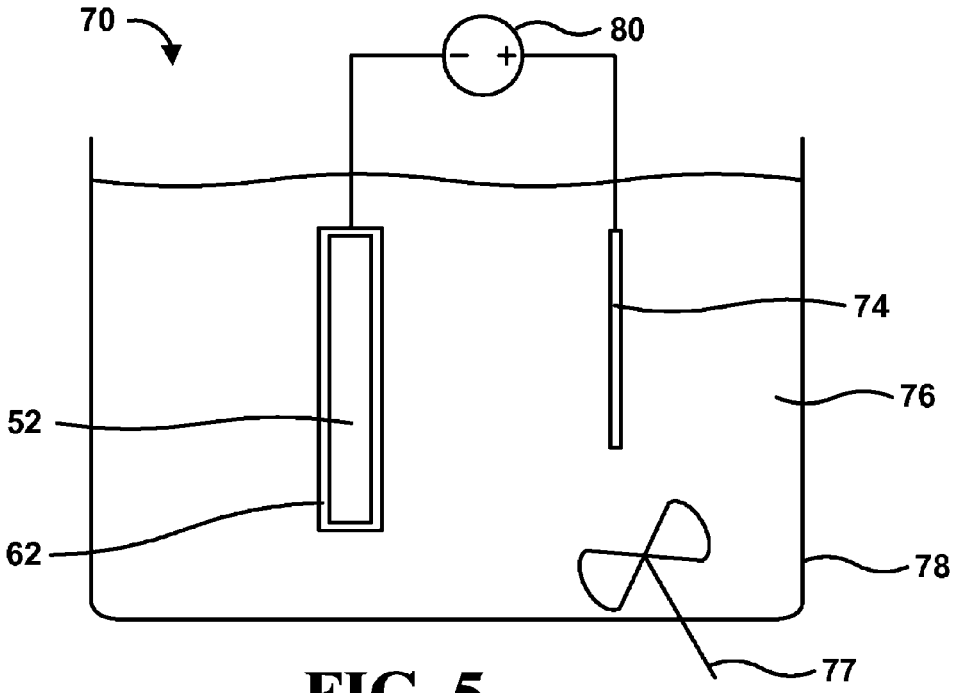
FIG. 5 is a side view illustrating a metallic substrate coated with a layer including a Pt-group metal, a reactive element, and Si immersed in a second electrophoretic bath.
Figure 6:
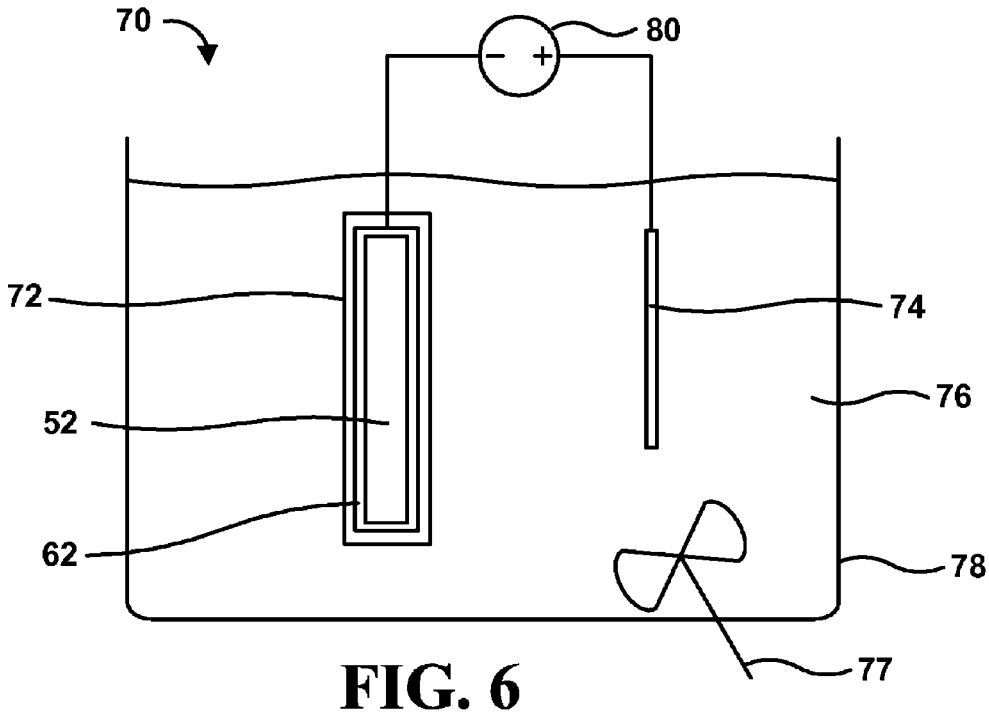
FIG. 6 is a side view illustrating a metallic substrate immersed in an electrophoretic bath coated with a first layer including a Pt-group metal, a reactive element, and Si, and a second layer including Al.

Alternatively, the Al deposition may be accomplished using an electrophoretic deposition process 70, as shown in FIGS. 5 and 6. Similarly to FIG. 3, an electrophoretic bath 78 is prepared which includes a suspension 76 including a coating composition, solvent or liquid carrier, and any necessary additives, such as activators and the like. The suspension 76 is agitated by an impeller 77 or other suitable agitator to keep the solids and additives in suspension. Coated substrate 52/62 is electrically coupled to a DC voltage source 80 as a cathode, and another conductive material 74 is connected to the DC voltage source 80 as an anode. The coated substrate 52/62 and conductive material 74 are submerged in the suspension 76, and the DC voltage source 80 is applied, causing a current to flow, and the positively-charged metal chelated complex coating composition to deposit on the negatively charged coated substrate 52/62.

In both pack cementation and electrophoretic deposition, the pack mix or suspension 76 may include an organo halocarbon. Based on presently available evidence, the organo halocarbon can act as an activator for the Al. The use of the organo halocarbon activator is particularly preferred for the electrophoretic deposition process, as conventional halide salt activators are not compatible with this process, but its use is also preferred for pack cementation.

Suitable organo halocarbons include, for example, fluoropolymers, chloropolymers, such as polyvinylchloride, and the like.

Suitable organo halocarbons can preferably be produced in granular form and are compatible with the liquid carrier in the electrophoretic suspension. One particularly preferred fluoropolymer is polytetrafluoroethylene (PTFE), which may be obtained from DuPont Fluoroproducts, Wilmington, Del., under the trade designation DuPont Teflon PTFE 60 and DuPont micronized PTFE powder, available under the trade designation Dupont Zonyl MP-1200.

During the electrophoretic process 70, the organo halocarbon and Al are substantially concurrently deposited on the coated substrate 52/62, forming layer 72, as shown in FIG. 6.

The electrophoretic suspension 76 may include a coating composition, liquid carrier, and any necessary additives, such as activators and the like.

Suitable liquid carriers include nitroalkanes, alcohols containing about 1 to about 6 backbone carbons, glycols, and the like, and mixtures of isopropanol and nitromethane are preferred. In some embodiments, the liquid carrier comprises about 55 wt. % to about 65 wt. % isopropanol and about 35 wt. % to about 45 wt. % nitromethane, more preferably about 60 wt. % isopropanol and about 40 wt. % nitromethane.

The electrophoretic suspension 76 may include a total solids content (including the coating composition) of about 15 g solids per L liquid carrier to about 40 g solids per L liquid carrier, preferably about 30 g solids per L liquid carrier.

The electrophoretic suspension 76 may further include an activating agent and an electrophoretically active agent, including those described above. Suitable electrophoretically active agents include zein, and preferred concentrations include about 1 g/L to about 3 g/L, more preferably about 2.2 g/L. Suitable activating agents include cobalt nitrate hexahydrate, and preferred concentrations include about 0.08 g/L to about 0.20 g/L, and a concentration of about 0.14 g/L is suitable.

The electrophoretically active agent and the activating agent may form a chelated complex which may surround the metal particles in the electrophoretic suspension 76 and impart a slight positive charge that causes the encased particle to migrate to and deposit on the negatively charged cathode.

The solids present in the electrophoretic suspension 76 may include an Al source, an organo halocarbon activator, and filler.

The Al source may include elemental Al, or may include alloy powders such as, for example (by weight) 55Al:45Cr, 42Al:40Cr:18Mn, 70Al:30Cr, other aluminum-chromium alloys, organo-aluminum compounds, and the like.

The filler may be a non-reactive oxide powder, such as aluminum oxide, zirconium, titanium, or hafnium oxide, and the like. Typically, the solids in the suspension 76 include about 0.5 wt. % to about 25 wt. % of the Al source, about 1 wt. % to about 10 wt. % of the organo halocarbon activator, and the balance filler.

Typical electrophoretic deposition of the Al may be carried out for up to about 6 minutes at a current density of about 1 $mA/cm^2$ to about 2 $mA/cm^2$ between the anode and cathode (substrate 52). Suitable voltages range from about 35 V to about 250 V, and may be chosen to provide the desired current density. The necessary voltage may be influenced by the composition of the electrophoretic bath and the distance between the anode and cathode (substrate 52). The suspension is maintained by mechanical agitation including, for example, an impeller 77. Further details regarding electrophoretic deposition processes are provided in U.S. Pat. Nos. 5,057,196 and 5,958,204 both to Creech et al., which are incorporated herein by reference in their entirety. Adjusting either the current density or deposition time, or both, may allow control over the green coat weight. The green coat weight affects the total amount of Al available to diffuse into the coating during subsequent heat treating steps. Preferred green coat weights range from about 12 $mg/cm^2$ to about 65 $mg/cm^2$, preferably about 15 $mg/cm^2$ to about 30 $mg/cm^2$.

Figure 7:
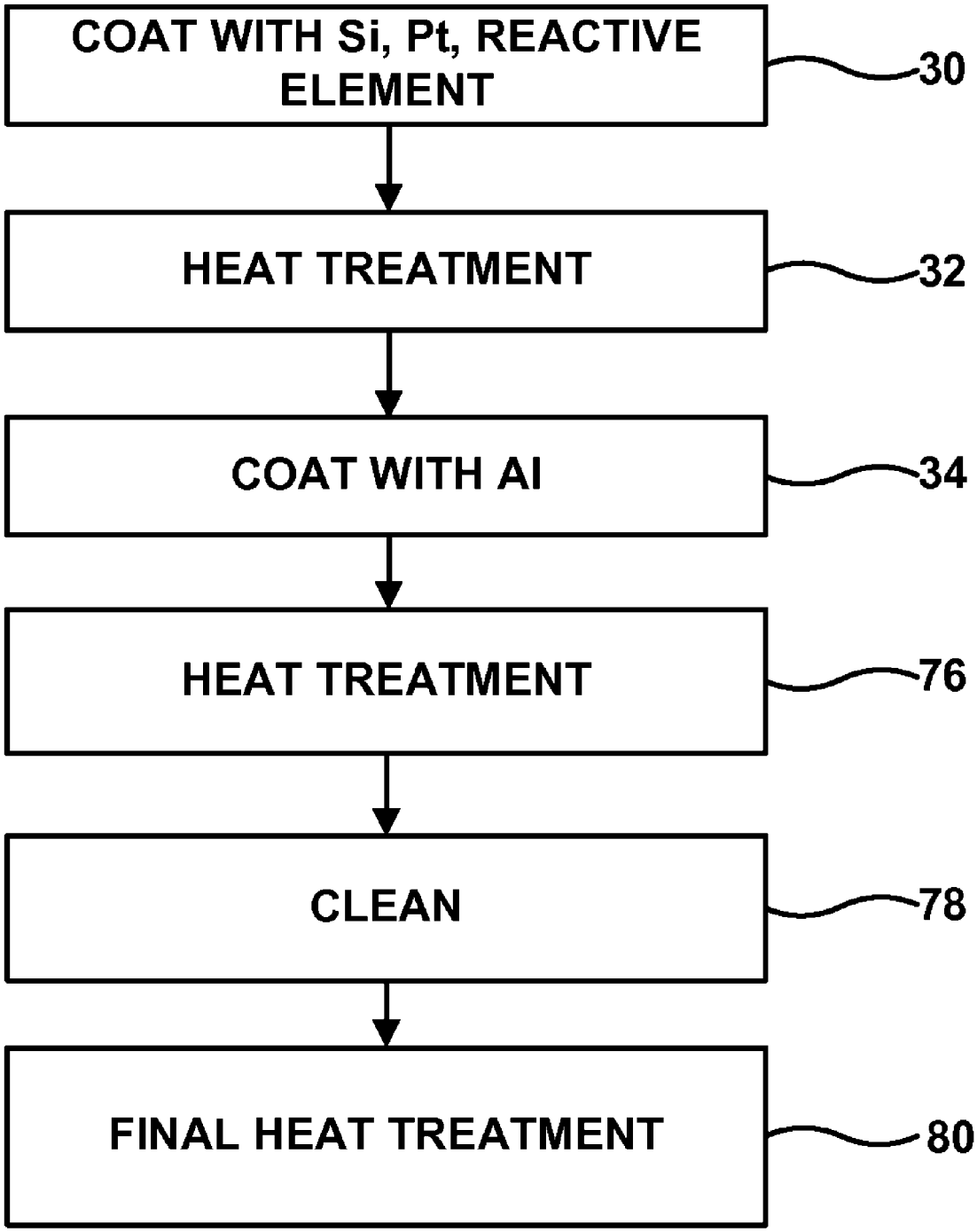
FIG. 7 is a flowchart illustrating an example method of coating a substrate.

After application of the second layer 72, the entire article 52/62/72 may undergo a series of additional steps, including a second heat treatment (76), cleaning, (78), and a final heat treatment step (80), as shown in FIG. 7. The heat treatment (76) facilitates interdiffusion of the Al and the elements on the coated substrate. Heat treatment is particularly useful when the Al is deposited using electrophoretic deposition. When electrophoretic deposition is used, the Al is substantially co-deposited with the organo halocarbon.

While not wishing to be bound by any theory, presently available evidence indicates that the heat treatment may cause the organo halocarbon to decompose, releasing halogens, which may then react with the Al, activating the Al. When the Al-halogen compound diffuses to the surface of the coated substrate 52/62, the Al reacts with and is bound to the surface. The reaction liberates the halogen, which is then free to react with and activate another Al atom in the green coat. Thus, the heat treatment step (76) can bind the Al to the coated substrate 52/62, in addition to facilitating interdiffusion between coated substrate 52/62 and layer 72.

By selecting the time and temperature of the heat treatment step (76), the total amount of Al bound to the surface of coated substrate 52/62 can be controlled. Typical heat treatments range from about 1475° F. to about 1975° F. for about 1 hour to about 4 hours. The heat treatment is preferably carried out in an oven under an inert atmosphere, such as a partial pressure (about −5 inches Hg) of argon.

After the second heat treatment step, the coated substrate may be cleaned (78), especially if a green coat was deposited by electrophoresis. The cleaning removes any excess green coat that is not chemically bound to the surface of the article. Cleaning may be accomplished by ultrasonic cleaning in water or a solvent such as methanol, or simply mechanically removing the residual unreacted bisque with a soft bristle brush, or the like.

After the cleaning step, the article may be exposed to a final heat treatment step (80), except in the case for pack cycles with temperatures high enough to cause interdiffusion of the Al with the substrate. The final heat treatment facilitates further diffusion of the coating elements and produces a more uniform coating. The final heat treatment step is preferably carried out at about 1975° F. to about 2080° F. for about 1 to about 4 hours, although any convenient temperature may be used.

Figure 1:
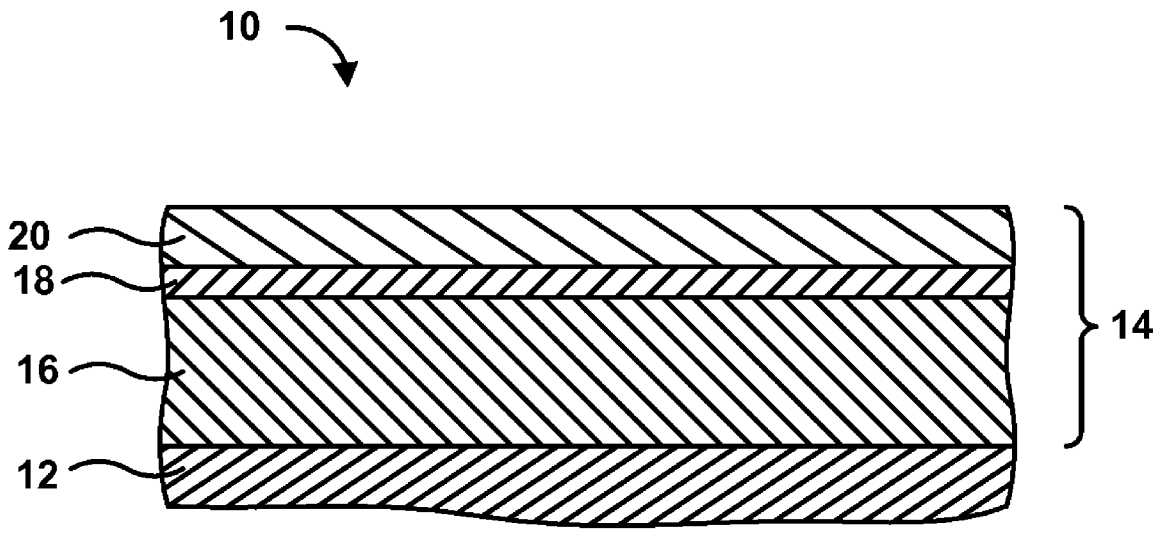
FIG. 1 is a cross-sectional view of an article with a thermal barrier coating.

The coatings described in this disclosure can be used in a wide variety of applications, but are particularly well suited to high-temperature mechanical systems, such as, for example, gas-turbine engines, that must operate in severe environments. A portion of a typical metallic article 10 used in a high-temperature mechanical system is shown in FIG. 1. The article 10 may include a Ni or Co-based superalloy substrate 12, which may be coated with a thermal barrier coating (TBC) 14. The thermal barrier coating 14 includes a thermally insulative ceramic topcoat 20 and an underlying metallic bond coat 16.

The topcoat 20, usually applied either by air plasma spraying or electron beam physical vapor deposition, is most often a layer of yttria-stabilized zirconia (YSZ) with a thickness of about 300-600 μm. The properties of YSZ include low thermal conductivity, high oxygen permeability, and a relatively high coefficient of thermal expansion.

The YSZ topcoat 20 is also made "strain tolerant" by depositing a structure that contains numerous pores and/or pathways. The consequently high oxygen permeability of the YSZ topcoat 20 imposes the constraint that the metallic bond coat 16 must be resistant to oxidation attack. The bond coat 16 therefore should be sufficiently rich in Al to form a layer 18 of a protective thermally grown oxide (TGO) scale of $\alpha$-$Al_2O_3$. In addition to imparting oxidation resistance, the TGO bonds the ceramic topcoat 20 to the bond coat 16.

As noted above, the methods described in the present disclosure provide enhanced control over the Al content of the metallic bond coat 16, as well as provide a surface composition such that upon exposure to elevated temperatures, a slow-growing, adherent oxide film is formed. This adherent thermally grown oxide (TGO) layer (18) extends the life of the YSZ topcoat by delaying the spallation or de-bonding of the layer from either the substrate or the YSZ topcoat. This is of great practical importance for increasing the durability of YSZ topcoats on turbine engine hardware, such as blades and vanes, which operate at high temperatures in more advanced gas turbine engines.

EXAMPLES

Example 1

A CMSX-4 substrate was first electrophoretically coated with a film of about 84 wt. % Pt, about 10 wt. % Si and about 6 wt. % Hf (XP-71), and heat treated at about 1900° F. for about 30 minutes in a vacuum. The coating composition after the heat treatment was about 13 at.% Al, 25 at.% Pt, 5 at.% Si, 1.5 at.% Hf, 4 at.% Cr, 6 at.% Co, and the balance Ni, with incidental amounts of substrate elements (other than Cr and Co).

A pack mixture (PM 1) containing about 1 wt. % Al powder, 1 wt. % PTFE type 60 powder, and a balance of 90 grit aluminum oxide was prepared. The sample was buried in PM 1 in a ceramic boat. The boat, PM 1 and sample were subjected to a temperature of about 1475° F. for about 1 hour in a partial pressure of argon of about −5 inches Hg. After removal from the pack, the sample had a composition gradient with the near-surface composition being about 25 at.% Al, 6 at.% Pt, 17 at.% Si, 0.2 at.% Hf, 2 at.% Cr, 7 at.% Co and the balance Ni, and the composition in the middle of the coating being about 15 at.% Al, 25 at.% Pt, 6 at.% Si, 1.7 at.% Hf, 5 at.% Cr, 5 at.% Co, and the balance Ni. After a final heat treatment of about 2000° F. for about 1 hour, the near-surface average composition to a depth of about 10 microns was about 23.5 at.% Al, 12 at.% Pt, 7 at.% Si, 4 at.% Cr, 6 at.% Co, 0.8 at.% Hf, 0.4 at.% W (diffused from the substrate) and the balance Ni.

Example 2

A second sample was prepared similarly to Example 1. However, the pack deposition was carried out at about 1925° F. for about 1 hour in a partial pressure of argon (about −5 inches Hg). The higher temperature was expected to result in a coating similar to that formed in a high temperature low activity when compared to Example 1. After pack deposition, the coating was cleaned by blasting with 220 grit aluminum oxide at about 20 psi. The sample showed a modest weight gain of about 4 mg/cm$^2$. Metallographic examination showed an Al-enriched top layer with an average near-surface composition of about 27.5 at.% Al, about 13 at.% Pt, about 6 at.% Si, about 0.7 at.% Hf, about 4 at.% Cr, about 5 at.% Co, and the balance Ni.

Example 3

Another sample of CMSX-4 was electrophoretically coated with XP-71 and heat treated at about 1900° F. for about 30 minutes in a vacuum. A second pack mix (PM 2) was prepared that included about 0.5 wt. % Al, about 5 wt. % Hf, about 5 wt. % PTFE type 60 resin powder, and the balance 90 grit aluminum oxide. The sample was buried in PM 2 in a ceramic boat and heat treated at about 1475° F. for about 1 hour in a partial pressure of argon (about −5 inches Hg). A post-coat diffusion heat treatment of about 2000° F. for about 1 hour was applied, and the average composition was about 14 at.% Al, 17 at.% Pt, 3 at.% Cr, 6 at. % Co, 1 at.% Hf, with the balance Ni, and incidental amounts of substrate elements. Compared to Example 1, PM 2 showed a slight enrichment of Al as well as an increase in the Hf content of the coating.

Example 4

After demonstrating PTFE type 60 resin powder is an effective activator for Al, the ingredients of the pack mix were incorporated into an electrophoretic bath.

The electrophoretic bath included solids comprising about 15 wt. % Al, 5 wt. % PTFE type 60 resin powder and about 80 wt. % fine aluminum oxide powder. The solids were mixed at a concentration of about 30 g total solids per liter liquid carrier into about 60 wt. % isopropyl alcohol and about 40 wt. % nitromethane. Along with the solids, about 2 g/L zein and about 0.14 g/L cobalt nitrate were added. A portion of a sample previously coated with XP-71 was submerged in the electrophoretic bath, attached to a DC voltage source as a cathode and coated with about 64.1 mg/cm$^2$ of solids.

The sample was then subjected to a heat treatment cycle of about 1925° F. for about 1 hour in a partial pressure of argon (about −5 inches Hg). The surface of the sample was then cleaned with by blasting with 220 grit aluminum oxide at about 20 psi. Metallographic evaluation revealed a change in microstructure and a thicker coating. X-ray energy dispersive analysis (XEDA) revealed an average near-surface coating composition of about 33 at.% Al, about 11 at.% Pt, about 2.5 at.% Si, about 0.2 at.% Hf, about 1.5 at.% Cr, about 3 at.% Co, and the balance Ni. After further heat treating at about 2080° F. for about 1 hour, the average composition in the middle of the coating was about 25 at.% Al, about 7 at. % Pt, about 5 at.% Si, about 0.6 at.% Hf, about 4 at.% Cr, about 6.6 at.% Co, and the balance Ni.

Example 5

A substrate of CMSX-4 first received a heavy (about 29 mg/cm$^2$) green coat of XP-71 by electrophoretic deposition, and was then heat treated at about 1900° F. for about 15 minutes. The sample was then cleaned using aluminum oxide powder. Another pack mixture included about 1 wt. % PTFE DuPont micronized Zonyl MP-1200 powder (hereinafter referred to as Zonyl MP-1200), about 1 wt. % Al, and about 98 wt. % of 90 grit aluminum oxide powder. The sample was immersed in the pack mixture, placed in a crucible and processed at about 1515° F. for about 1 hour in an Ar (−5" Hg) partial pressure. After removal of the unreacted bisque, the sample was further processed by heat treating at about 2000° F. for 1 hour in vacuum. The sample was lightly blasted with 220 grit aluminum oxide to provide a clean surface for metallographic Ni plating and preparation for mounting in cross-section, and polishing. XEDA analysis of the 10 micron thick surface layer showed an average composition of about 22 at.% Al, about 11 at.% Pt, about 8 at. Si, about 0.8 at. % Hf, about 5 at.% Cr, about 5 at.% Co, with the balance Ni, and incidental amounts of substrate elements.

Example 6

A PtSiHf alloy powder with a nominal composition of 91 wt. % Pt, 4 wt. % Si and 5 wt. % Hf (XP-74) was electrophoretically deposited at a green coating weight of about 21.0 mg/cm$^2$ on to a CMSX-4 substrate. The green coat was subsequently diffused at about 2125° F. for about 30 minutes in a vacuum. A second electrophoretic bath was prepared including about 10 wt. % 70Al-30Cr alloy powder, about 5 wt. % PTFE Zonyl MP-1200 powder and about 85 wt. % 1 micron nominal particle size alumina powder mixed into a liquid carrier including about 60 wt. % isopropanol and about 40 wt. % nitromethane, with a total solids content of about 30 g solids per liter liquid carrier. Additionally, the electrophoretic bath included about 2 g/L zein and about 0.14 g/L cobalt nitrate hexahydrate. The sample was immersed in the electrophoretic bath and connected to a DC voltage source as a cathode. Electrophoretic deposition resulted in a green coat of about 21 mg/cm$^2$ on the substrate.

The substrate including the electrophoretic deposit was placed in a crucible surrounded with 90 grit white aluminum oxide and exposed to a heat treatment at about 1475° F. for about 2 hours under a partial pressure of Ar. After removal from the furnace, the electrophoretic deposit bisque remnants were carefully removed and the sample further heat treated for about 1 hour at about 2080° F. to form the final coating. The near-surface composition determined by XEDA was about 18 at.% Al, about 19 at.% Pt, about 1.3 at.% Si, about 0.25 at.% Hf, about 2.5 at.% Cr, about 6 at.% Co, and the balance Ni.

Example 7

A CMSX-4 substrate was processed by electrophoretically depositing XP-74 onto the substrate from an electrophoretic bath to a green coat weight of about 21 mg/cm$^2$. The green coat was diffused into the substrate using a heat treatment at about 2125° F. for about 30 minutes in a vacuum. The sample was then processed using an approximately 20 psi 220 grit aluminum oxide blast cleaning step. A second electrophoretic bath was prepared by mixing about 9 wt. % Al, about 5 wt. % PTFE Zonyl MP-1200 powder and about 86 wt. % 1 micron nominal particle size alumina powder in a liquid carrier comprising about 60 wt. % isopropanol and about 40 wt. % nitromethane, producing a suspension with a total solids concentration of about 30 g/L. Also included in the suspension was about 2 g/L zein and about 0.14 g/L cobalt nitrate hexahydrate. The sample was submersed in the electrophoretic bath and connected to a DC voltage source as the cathode.

Figure 8:
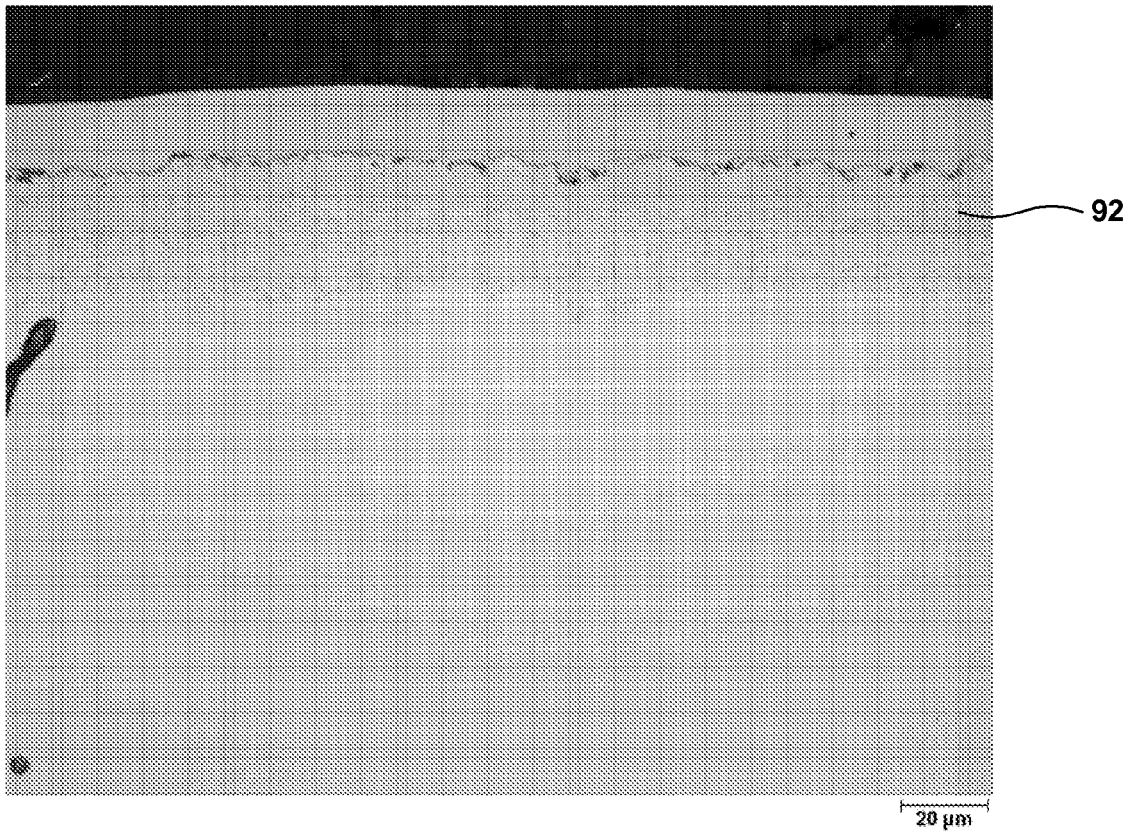
FIG. 8 is a photograph of a cross-section of a substrate coated with a $\gamma$-Ni+–$\gamma'Ni_3Al$ coating.

The electrophoretic deposition resulted in a green coat of about 27 mg/cm$^2$. The sample was then heat treated at about 1515° F. for about 1 hour in a partial pressure of argon (about −5 inches Hg). The residual, undiffused bisque was carefully removed and the sample further heat treated at about 2080° F. for about 1 hour in a vacuum to form the final coating. The final composition as measured by XEDA at a depth of about 2 microns below the surface was about 23 at.% Al, about 13 at.% Pt, about 1 at.% Si, about 0.25 at.% Hf, about 6 at.% Co, with the balance Ni. The final coating had a typical γ-γ' microstructure 92, as shown in FIG. 8.

Example 8

A CMSX-4 sample was processed by electrophoretically depositing XP-74 at a green coat weight of about 30 mg/cm$^2$. The sample was then heat treated at about 2125° F. for about 30 minutes in a vacuum. The average surface coating composition to a depth of about 10 microns was about 9 at.% Al, about 17 at.% Pt, about 3 at.% Si, about 0.3 at.% Hf, about 6 at.% Cr, about 7 at.% Co, with the balance Ni, and incidental amounts of substrate elements. A second electrophoretic bath was prepared by mixing about 10 wt. % Al, about 5 wt. % PTFE Zonyl MP-1200 powder and about 85 wt. % 1 micron nominal particle size alumina powder in a liquid carrier comprising about 60 wt. % isopropanol and about 40 wt. % nitromethane, producing a suspension with a total solids concentration of about 30 g/L. Also included in the suspension was about 2 g/L zein and about 0.14 g/L cobalt nitrate hexahydrate. The sample was submerged in the electrophoretic bath and a green coat of about 42 mg/cm$^2$ was deposited.

The sample was then subjected to a heat treatment of about 1515° F. for about 1 hour in a partial pressure of Ar (about −5 inches Hg). The residual bisque was removed and the sample was further heat treated at about 2080° F. for about 1 hour. XEDA results for the 10 micron thick surface layer showed an average composition of about 23 at.% Al, about 10 at. % Pt, about 0.3 at.% Hf, about 3 at.% Cr, about 7 at.% Co, with the balance Ni, and incidental amounts of other substrate elements.

Example 9

Figure 9:
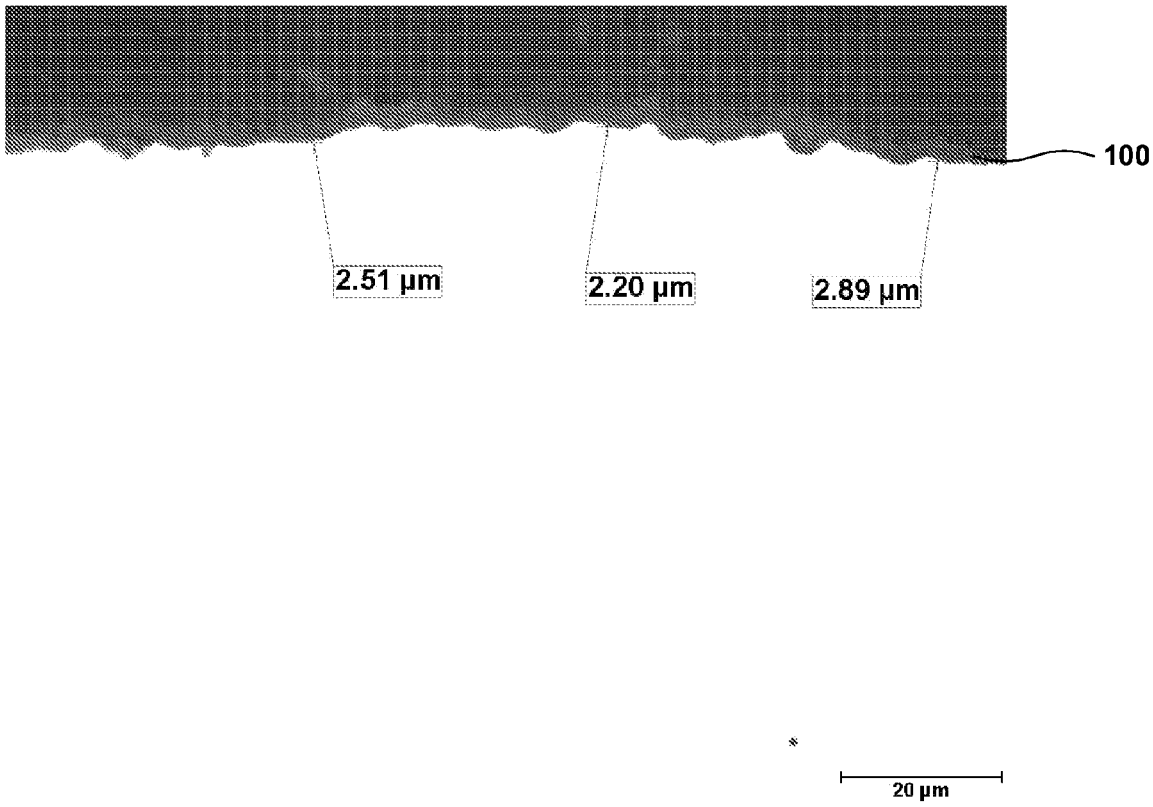
FIG. 9 is a photograph of a cross-section of a substrate coated with a $\gamma$-Ni+–$\gamma'Ni_3Al$ coating following a cyclic oxidation test.

An example of the thin oxide film formed on the sample from Example 7 above was subjected to a cyclic oxidation test at 1150° C. (2100° F.) for 100 cycles consisting of 50 minutes hot/10 minutes cooling. The results are shown in FIG. 9. The oxide 100 is well adhered to the substrate, and thin relative to some traditional PtAl coatings.

Example 10

Figure 10:
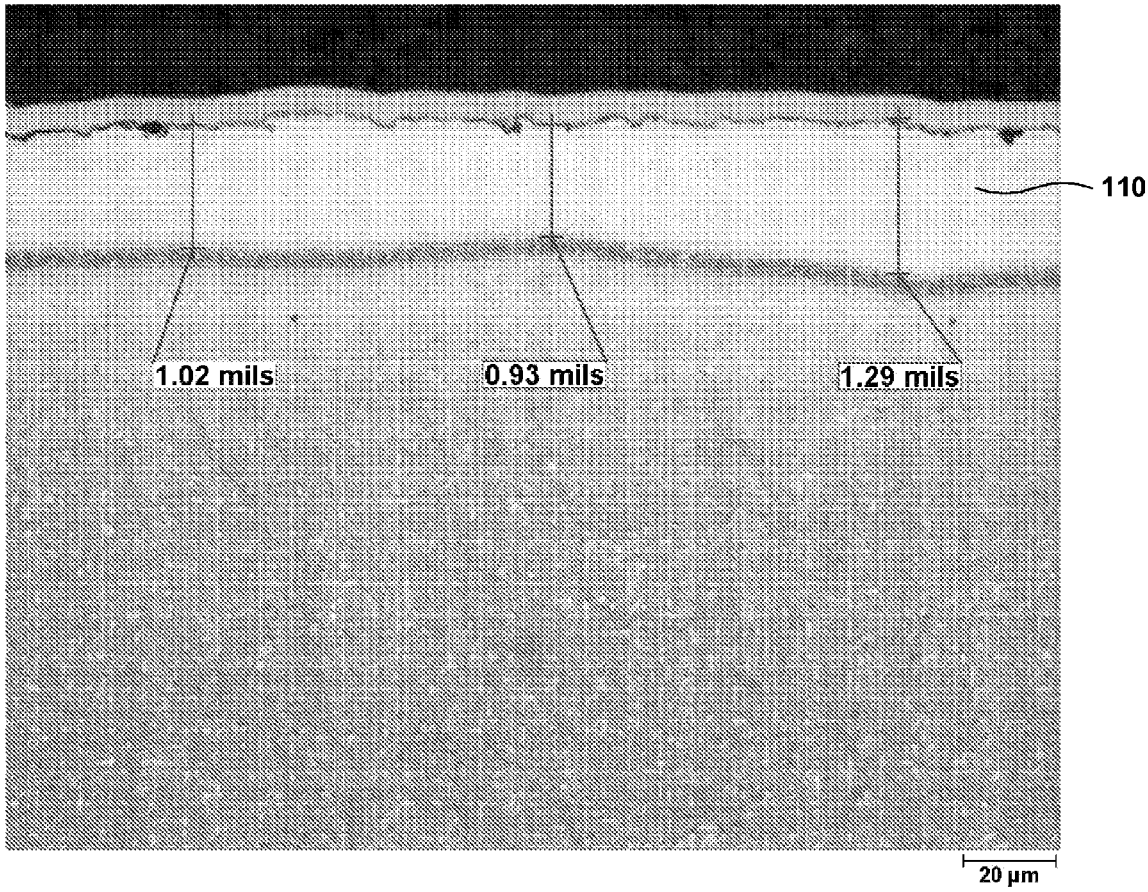
FIG. 10 is a photograph of a cross-section of a substrate coated with a layer including Pt, Si, and Hf.

A CMSX-4 sample was lightly blasted with 220 grit aluminum oxide at about 20-25 psi and then immersed in methanol and ultrasonically cleaned to loosen any grit particles that may have been embedded in the surface of the sample. A green coat weighing about 13.72 mg/cm$^2$ of XP-74 was electrophoretically deposited on the substrate, and the sample was heat treated for about 30 minutes at about 2125° F. in a vacuum. The sample was then etched with a solution of 33% acetic acid ($CH_3COOH$), 33% nitric acid ($HNO_3$), 1% hydrofluoric acid (HF), and 33% water to reveal the resultant microstructure. FIG. 10 shows the resulting microstructure, including a coating 110 ranging from about 0.93 mils to about 1.29 mils thick.

Example 11

Figure 11:
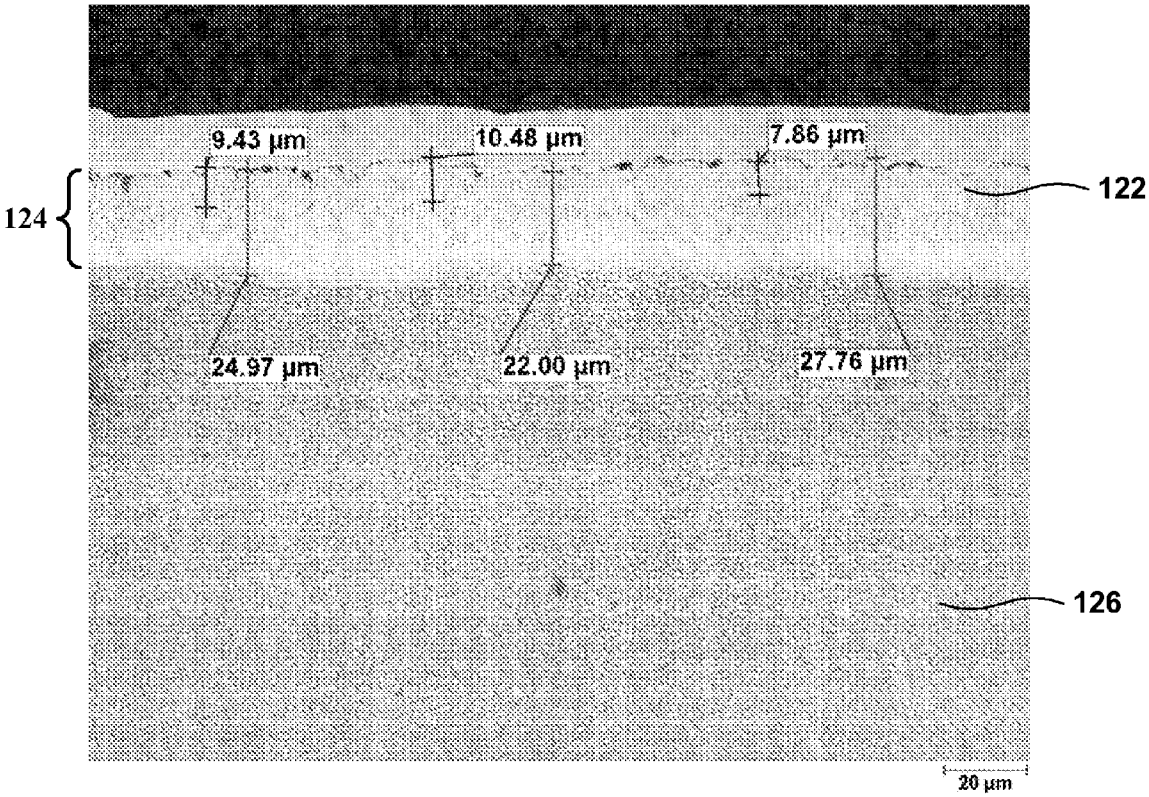
FIG. 11 is a photograph of a cross-section of a substrate coated with a $\gamma$-Ni+–$\gamma'Ni_3Al$ coating.

Another CMSX-4 sample was processed similar to the sample in Example 10, except that the green coat weight was about 19.38 mg/cm$^2$. In a second step, a green coat composition of about 5 wt. % Al, 5 wt. % PTFE Zonyl MP-1200, and 90 wt. % alumina (1μ nominal particle size) was electrophoretically deposited onto the sample and heat treated in a furnace under a partial pressure of Ar (about −5 inches Hg) at about 1515° F. for about 1 hour. The temperature was ramped to 1515° F. at a rate of about 15° F./minute. At the conclusion of the heat treatment, the furnace was gas fan cooled to near ambient temperature. Upon removal from the furnace, the excess unreacted bisque was gently removed from the sample. The sample was then placed back into the furnace for a post-coat heat treatment under vacuum at about 2000° F. for about 1 hour. After a low-pressure (about 20 to about 25 psi) dry hone clean-up with 220 grit aluminum oxide, the sample was submitted for a semi-quantitative x-ray energy-dispersive analysis (XEDA) to determine the final coating composition. FIG. 11 shows the resulting microstructure after the second step with an outer layer 122 that is somewhat enriched in Al. The overall average composition of the 10μ surface layer 124 was clearly in the γ+γ' PtAl composition range: about 21.8 at.% Al, about 17.1 at.% Pt, about 1.5 at.% Si, about 0.17 at.% Hf, about 4.4 at.% Cr, with the balance primarily Ni. The coating was etched with same etchant as in Example 10 to clearly show the surface layer 124 in comparison to the underlying CMSX-4 substrate 126.

Example 12

Figure 12:
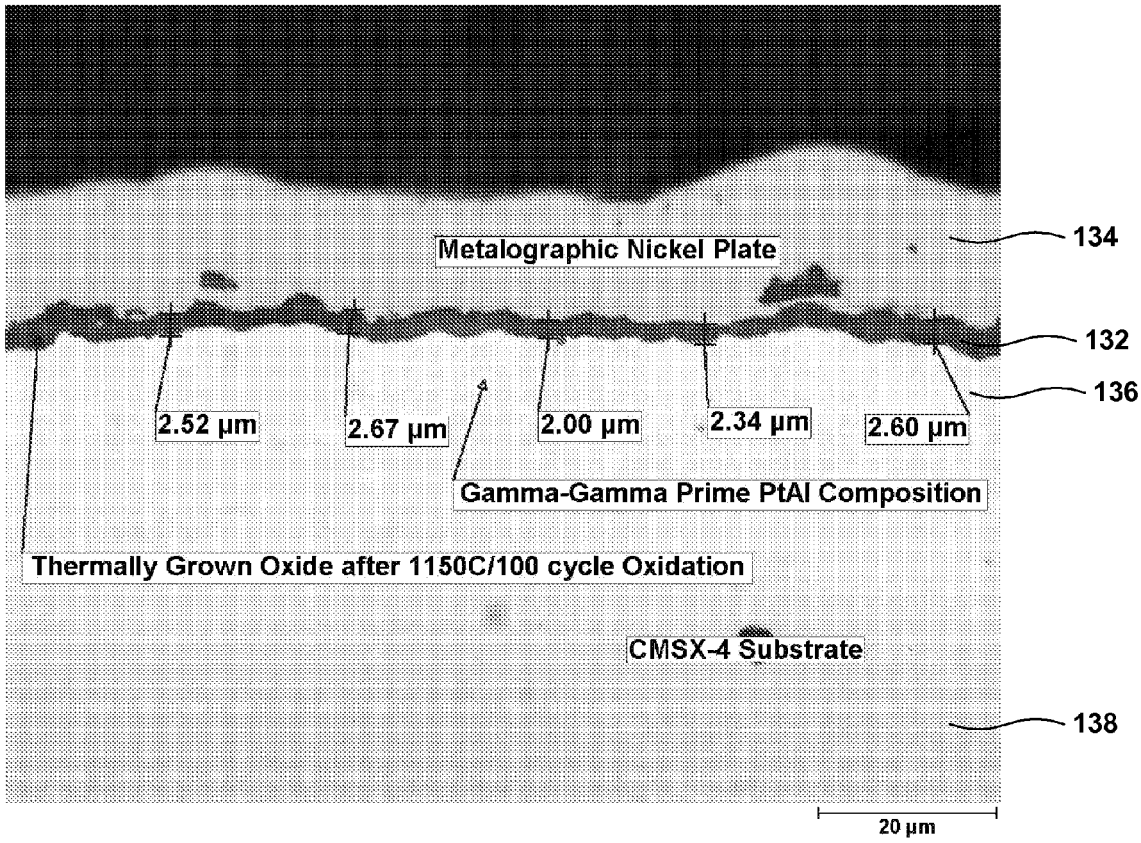
FIG. 12 is a photograph of a cross-section of a substrate coated with a $\gamma$-Ni+–$\gamma'Ni_3Al$ coating following a cyclic oxidation test.

The coating from Example 11 was exposed to 100 cycles of 1150° C. (2100° F.) in air. The cycles consisted of 50 minutes under the high temperature followed by 10 minutes of cooling with four fans blowing on the samples to cool them to near ambient temperature. After 100 cycles, the samples were etched and photographed as shown in FIG. 12. The thin thermally grown oxide layer 132 is shown along with a metallographic nickel plate 134, the γ+γ' coating 136, and the CMSX-4 substrate 138.

Example 13

Figure 13:
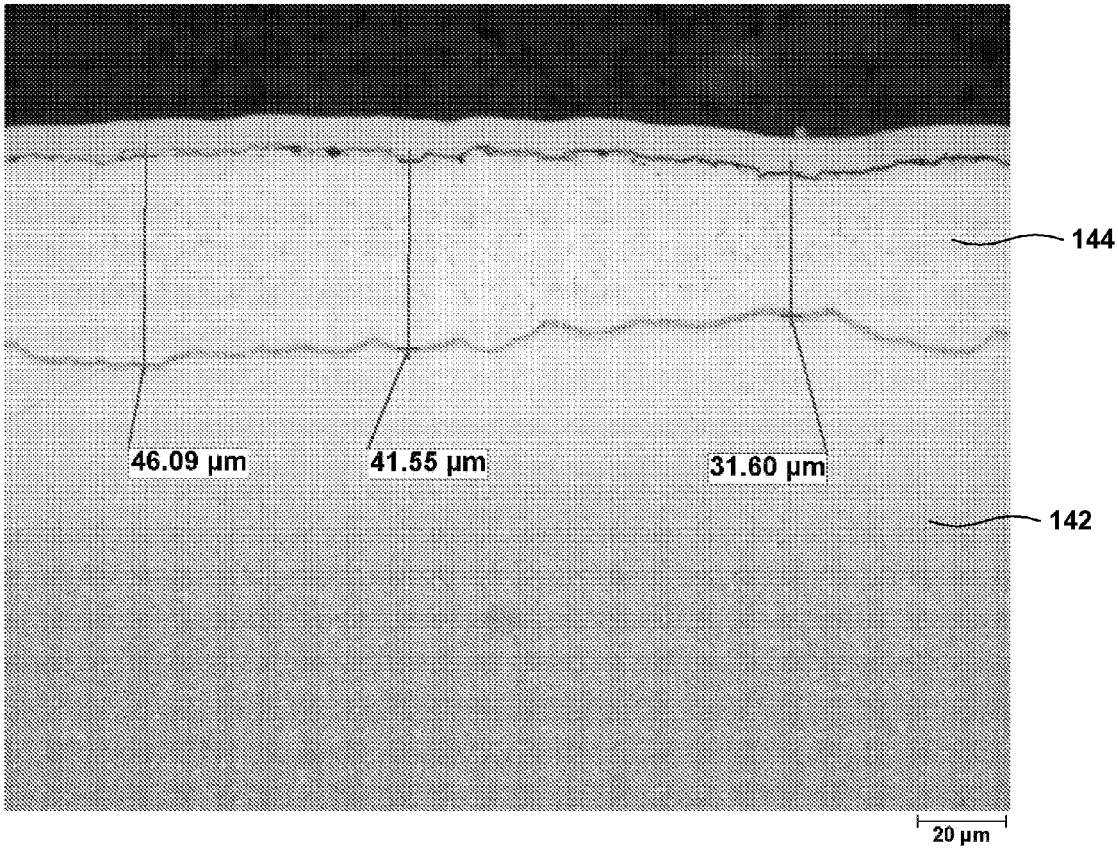
FIG. 13 is a photograph of a cross-section of a substrate coated with a layer including Pt, Si, and Hf.

Another CMSX-4 sample was lightly blasted with 220 grit aluminum oxide at about 20-25 psi and then immersed in methanol and ultrasonically cleaned to loosen any grit particles that may have been embedded in the surface of the sample. An electrophoretic suspension including solids comprising about 84 wt. % Pt, about 5 wt. % Si, and about 6 wt. % Hf, with the balance impurities including a small amount of oxygen (XP-96) was prepared, and the CMSX-4 sample was submersed in the suspension. A green coat weighing about 19.53 mg/cm$^2$ of the XP-96 was deposited on the CMSX-4, and the sample was heat treated at about 2000° F. for about 30 minutes in a vacuum furnace. The sample was then etched with a solution of about 33% acetic acid ($CH_3COOH$), about 33% nitric acid ($HNO_3$), about 1% hydrofluoric acid (HF), and about 33% water to reveal the resultant microstructure shown in FIG. 13 including CMSX-4 substrate 142 and coating 144.

Example 14

Figure 14:
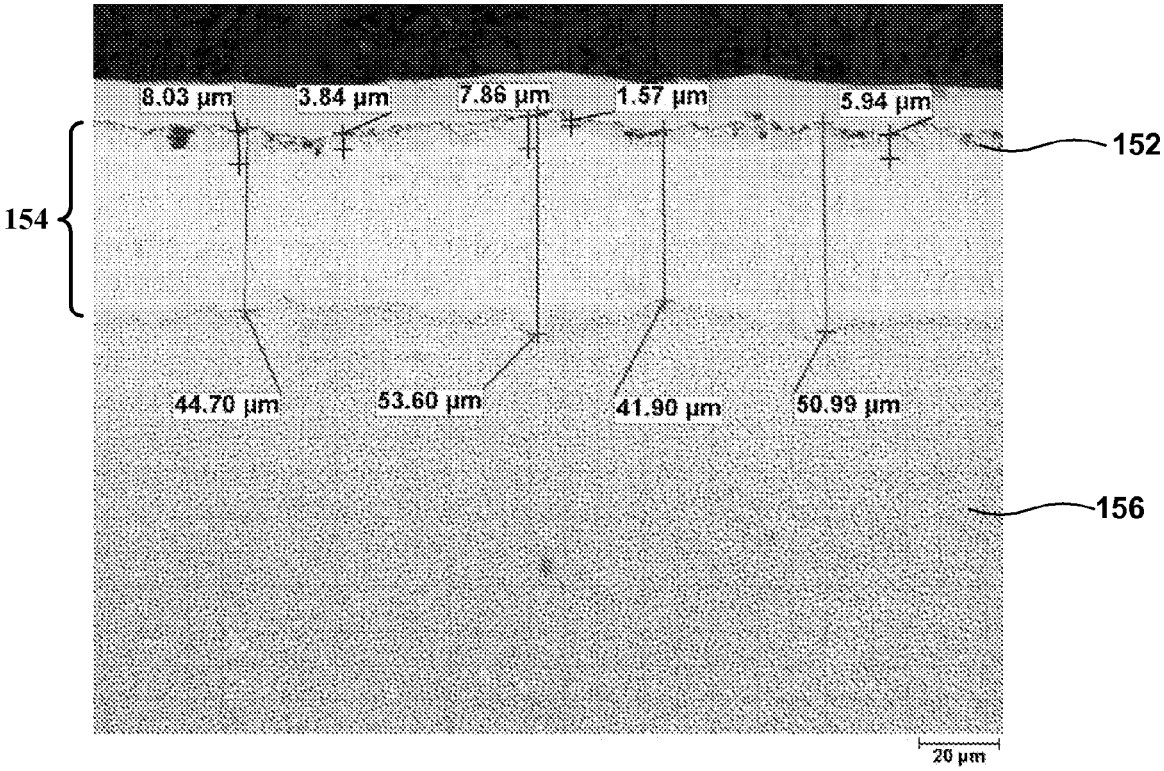
FIG. 14 is a photograph of a cross-section of a substrate coated with a $\gamma$-Ni+–$\gamma'Ni_3Al$ coating.

Another CMSX-4 sample was processed similar to the sample in Example 13, except that the green coat weight was about 18.36 mg/cm$^2$. In a second step, a green coat composition of about 5 wt. % Al, 3.5 wt. % PTFE Zonyl MP-1200, and 91.5 wt. % alumina (1μ nominal particle size) was electrophoretically deposited onto the sample and heat treated in a furnace under a partial pressure of Ar (about −5 inches Hg) at about 1515° F. for about 1 hour. The temperature was ramped to 1515° F. at a rate of about 15° F./minute. At the conclusion of the heat treatment, the furnace was gas fan cooled to near ambient temperature. Upon removal from the furnace, the excess unreacted bisque was gently removed from the sample. The sample was then placed back into the furnace for a post-coat heat treatment under a vacuum at about 2000° F. for about 1 hour. After a low-pressure (about 20 to about 25 psi) dry hone clean-up with 220 grit aluminum oxide, the sample was submitted for a semi-quantitative x-ray energy-dispersive analysis (XEDA) to determine the final coating composition. FIG. 14 shows the resulting microstructure after the second step with a thin outer layer 152 that is somewhat enriched in Al. The overall average composition of the 10 g surface layer 154 was clearly in the γ+γ' PtAl composition range of about 20.0 at.% Al, about 16.1 at.% Pt, about 2.5 at.% Si, about 0.38 at.% Hf, about 2.8 at.% Cr, with the balance primarily Ni. The coating was etched with same etchant as in Example 10 to clearly show the surface layer 154 in comparison to the underlying CMSX-4 substrate 156.

Example 15

Figure 15:
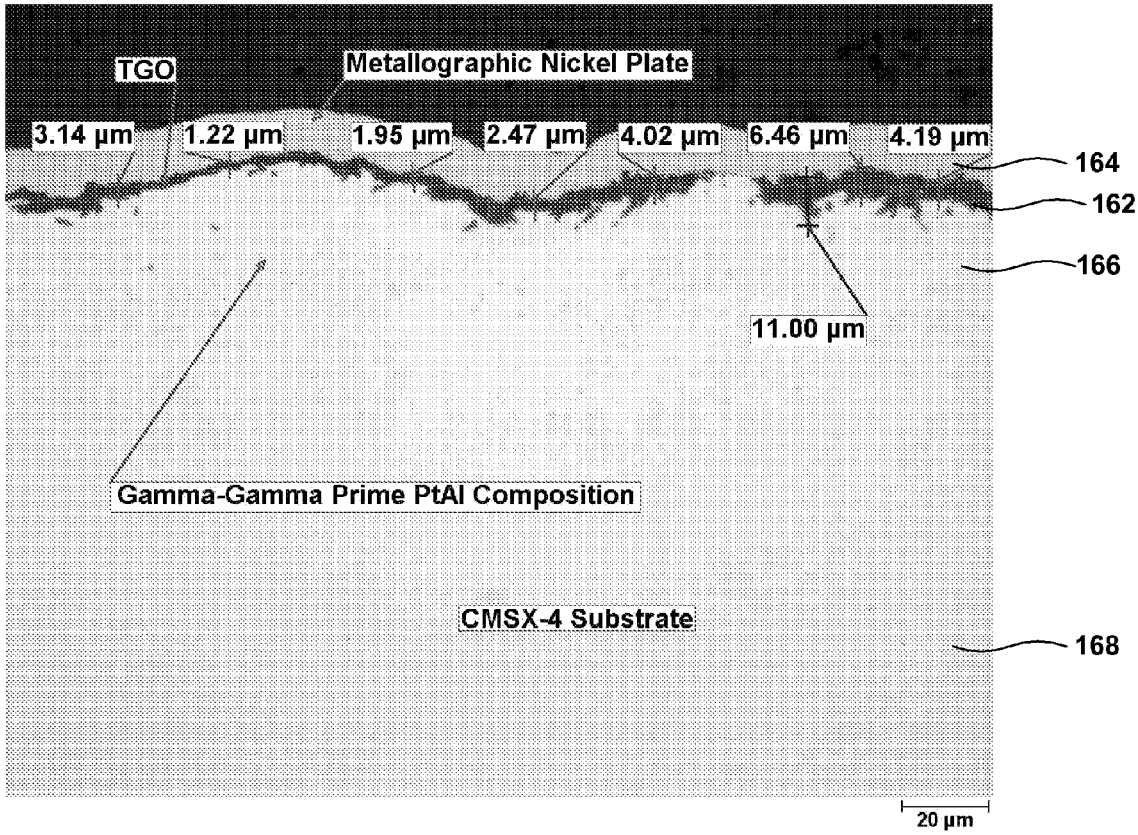
FIG. 15 is a photograph of a cross-section of a substrate coated with a $\gamma$-Ni+–$\gamma'Ni_3Al$ coating following a cyclic oxidation test.

The coating from Example 14 was exposed to 100 cycles of 1150° C. (2100° F.) in air. The cycles consisted of 50 minutes under the high temperature followed by 10 minutes of cooling with four fans blowing on the samples to cool them to near ambient temperature. After 100 cycles, the samples were etched and photographed as shown in FIG. 15. The thin thermally grown oxide layer 162 is shown along with a metallographic nickel plate 164, the γ+γ' coating 166, and the CMSX-4 substrate 168.

Various embodiments of the invention have been described. These and other embodiments are within the scope of the following claims.

The invention claimed is:

1. A method comprising:

electrophoretically depositing a powder comprising a mixture of a Pt group metal, Si, and a reactive element selected from the group consisting of Hf, Y, La, Ce, Zr, and combinations thereof on a substrate to form a first layer thereon, wherein the first layer comprises the Pt group metal, Si and the reactive element selected from the group consisting of Hf, Y, La, Ce, Zr, and combinations thereof; and depositing on the first layer a second layer comprising Al to form a coating comprising a γ-Ni+γ'-$Ni_3Al$ phase constitution.

2. The method of claim 1, wherein the Pt-group metal comprises at least one of Pt, Pd, Ir, Rh and Ru.

3. The method of claim 1, wherein the coating further comprises at least one of Cr, Co, Mo, Ta, Ti, W, and Re.

4. The method of claim 1, wherein the powder comprises about 84 wt. % to about 93 wt. % Pt, about 3 wt. % to about 12 wt. % Si and about 2 wt. % to about 6 wt. % Hf.

5. The method of claim 1, wherein the at least one of the first and second layers are deposited by electrophoresis.

6. The method of claim 5, wherein the second layer is deposited from an electrophoretic suspension comprising solids including about 0.5 wt. % to about 25 wt. % of an Al source, about 1 wt. % to about 10 wt. % of an organo halocarbon activator, and a filler.

7. The method of claim 6, wherein the Al source comprises at least one of elemental Al, an aluminum-chromium alloy, an organo-aluminum compound, or an aluminum-chromium-manganese alloy.

8. The method of claim 1, wherein the second layer is deposited by pack cementation.

9. The method of claim 8, wherein the pack comprises about 0.5 wt. % Al to about 5 wt. % Al, about 1 wt. % to about 10 wt. % organo halocarbon activator, less than about 5 wt. % of at least one reactive element comprising Hf, Y, La, Ce, and Zr, and a filler.

10. The method of claim 1, wherein the second layer is deposited from a source comprising Al and an organo halocarbon activator.

11. The method of claim 10, wherein the organo halocarbon activator comprises polytetrafluoroethylene.

12. The method of claim 1, wherein the coating comprises a predominately $\gamma$-Ni+$\gamma'$-$Ni_3Al$ phase constitution.

13. The method of claim 1, further comprising applying at least one heat treatment following depositing at least one of the first and second layers.

14. The method of claim 1, further comprising applying a heat treatment after depositing the first layer.

15. The method of claim 14, wherein the first layer comprises up to about 30 at.% of a Pt-group metal, up to about 2 at.% of a reactive element, and up to about 28 at.% Si.

16. The method of claim 14, wherein the first layer comprises about 10 at.% to about 30 at.% of a Pt-group metal, about 0.3 at.% to about 2 at.% of a reactive element, and about 2 at.% to about 28 at.% Si.

17. The method of claim 15, wherein the first layer comprises up to about 20 at.% Al, up to about 8 at.% Cr, and up to about 8 at.% Co.

18. The method of claim 16, wherein the first layer comprises about 10 at.% to about 20 at.% Al, about 2 at.% to about 8 at.% Cr, and about 4 at.% to about 8 at.% Co.

19. A method comprising:

electrophoretically depositing a powder comprising a substantially homogeneous mixture of a Pt group metal, Si, and a reactive element selected from the group consisting of Hf, Y, La, Ce, Zr, and combinations thereof on a substrate to form a first layer comprising the Pt group metal, Si, and the reactive element; and depositing a second layer comprising Al on the first layer to form an alloy including a $\gamma$-Ni+$\gamma'$-$Ni_3Al$ phase constitution, wherein the second layer is deposited with an organo halocarbon activator.

20. The method of claim 19, wherein the organo halocarbon comprises polytetrafluoroethylene.

21. The method of claim 19, wherein the first layer is deposited using electrophoresis.

22. The method of claim 19, wherein the second layer is deposited with a pack cementation process.

23. The method of claim 22, wherein the pack comprises about 0.5 wt. % Al to about 5 wt. % Al, about 1 wt. % to about 10 wt. % fluorocarbon, less than about 5 wt. % of the reactive element, and a filler.

24. The method of claim 19, wherein the second layer is deposited using electrophoresis.

25. The method of claim 24, wherein the second layer is deposited from an electrophoretic suspension comprising solids including about 0.5 wt. % to about 25 wt. % of an Al source, about 1 wt. % to about 10 wt. % of an organo halocarbon activator, and a filler.

26. The method of claim 19, further comprising applying a heat treatment following depositing at least one of the first and second layers.

27. The method of claim 19, further comprising applying a heat treatment after depositing both the first and the second layers.

28. The method of claim 19, wherein the alloy comprises a predominately $\gamma$-Ni+$\gamma'$-$Ni_3Al$ phase constitution.

29. The method of claim 1, further comprising:

forming an alloy comprising the Pt-group metal, Si, and the reactive element; and grinding the alloy into the powder comprising the mixture of the Pt group metal, Si, and the reactive element.

30. The method of claim 1, wherein the powder comprising the mixture of the Pt group metal, Si, and the reactive element comprises a substantially homogeneous mixture of the Pt group metal, Si, and the reactive element.

* * * * *